US010362426B2

(12) United States Patent
Wang et al.

(10) Patent No.: US 10,362,426 B2
(45) Date of Patent: Jul. 23, 2019

(54) UPMIXING OF AUDIO SIGNALS

(71) Applicant: DOLBY LABORATORIES LICENSING CORPORATION, San Francisco, CA (US)

(72) Inventors: Jun Wang, Beijing (CN); Lie Lu, San Francisco, CA (US); Lianwu Chen, Beijing (CN); Mingqing Hu, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/538,892

(22) PCT Filed: Feb. 9, 2016

(86) PCT No.: PCT/US2016/017071
§ 371 (c)(1),
(2) Date: Jun. 22, 2017

(87) PCT Pub. No.: WO2016/130500
PCT Pub. Date: Aug. 18, 2016

(65) Prior Publication Data

US 2018/0262856 A1 Sep. 13, 2018
US 2019/0052991 A9 Feb. 14, 2019

Related U.S. Application Data

(60) Provisional application No. 62/117,229, filed on Feb. 17, 2015.

(30) Foreign Application Priority Data

Feb. 9, 2015 (CN) ..... 2015 1 0066647

(51) Int. Cl.
*H04S 5/00* (2006.01)
*H04R 1/32* (2006.01)
*H04S 7/00* (2006.01)

(52) U.S. Cl.
CPC ..... *H04S 5/005* (2013.01); *H04R 1/323* (2013.01); *H04S 7/308* (2013.01); *H04S 2400/11* (2013.01)

(58) Field of Classification Search
CPC ..... H04S 5/005; H04S 7/308; H04S 2400/11; H04R 1/323
See application file for complete search history.

(56) References Cited

U.S. PATENT DOCUMENTS 8,023,660 B2 9/2011 Faller
2008/0232601 A1* 9/2008 Pulkki ..... H04S 7/302 381/1

(Continued)

FOREIGN PATENT DOCUMENTS

CN 101816191 5/2010
CN 103650537 3/2014

(Continued)

OTHER PUBLICATIONS

Breebaart J. et al., "MPEG Spatial Audio Coding/MPEG Surround: Overview and Current Status", AES Convention: 119, pp. 1-17, Oct. 1, 2005.

(Continued)

*Primary Examiner* — David L Ton

(57) ABSTRACT

Example embodiments disclosed herein relates to upmixing of audio signals. A method of upmixing an audio signal is described. The method includes decomposing the audio signal into a diffuse signal and a direct signal, generating an audio bed at least in part based on the diffuse signal, the audio bed including a height channel, extracting an audio object from the direct signal, estimating metadata of the (Continued)

audio object, the metadata including height information of the audio object; and rendering the audio bed and the audio object as an upmixed audio signal, wherein the audio bed is rendered to a predefined position and the audio object is rendered according to the metadata. Corresponding system and computer program product are described as well.

9 Claims, 4 Drawing Sheets

(56) References Cited

U.S. PATENT DOCUMENTS

| | | | | |
|---|---|---|---|---|
| 2009/0092259 | A1 | 4/2009 | Jot | |
| 2010/0169103 | A1* | 7/2010 | Pulkki | H04S 7/302 704/500 |
| 2011/0200196 | A1 | 8/2011 | Disch | |
| 2012/0082319 | A1 | 4/2012 | Jot | |
| 2013/0064374 | A1 | 3/2013 | Lee | |
| 2014/0119581 | A1 | 5/2014 | Tsingos | |
| 2014/0133682 | A1 | 5/2014 | Chabanne | |
| 2014/0133683 | A1* | 5/2014 | Robinson | H04S 3/008 381/303 |
| 2015/0223002 | A1* | 8/2015 | Mehta | H04S 7/30 381/303 |
| 2015/0281842 | A1* | 10/2015 | Yoo | G06F 3/16 381/80 |
| 2015/0350804 | A1* | 12/2015 | Crockett | H04R 5/02 381/307 |
| 2016/0150343 | A1* | 5/2016 | Wang | G10L 19/20 381/103 |
| 2017/0206907 | A1 | 7/2017 | Wang | |

FOREIGN PATENT DOCUMENTS

| | | |
|---|---|---|
| WO | 2011/090834 | 7/2011 |
| WO | 2013/192111 | 12/2013 |
| WO | 2014/036121 | 3/2014 |
| WO | 2014/043476 | 3/2014 |
| WO | 2014/049267 | 4/2014 |
| WO | 2014/076030 | 5/2014 |
| WO | 2014/076058 | 5/2014 |
| WO | 2014/102129 | 7/2014 |
| WO | 2014/135235 | 9/2014 |
| WO | 2014/204997 | 12/2014 |
| WO | 2016/014815 | 1/2016 |
| WO | 2016/036637 | 3/2016 |

OTHER PUBLICATIONS

Tsingos N. et al., "Surround Sound with Height in Games Using Dolby Pro Logic IIz", AES Conference: 41st International Conference: Audio for Games, pp. 1-11, Feb. 2, 2011.

Goodwin M. et al., "Multichannel Surround Format Conversion and Generalized Upmix", Affliation: Creative ATC AES Conference: Intelligent Audio Environments, pp. 1-9, Mar. 1, 2007.

Walther A. et al., "Direct-ambient decomposition and upmix of surround signals", 2011 IEEE Workshop on Applications of Signal Processing to Audio and Acoustics, p. 277-80, Oct. 16-19, 2011.

Dressler, R. Dolby Surround Prologic II de-coder, Principles of Operation, Tech. Rep. Dolby Laboratories, 2000.

Thompson, J. et al "Direct-Diffuse Decomposition of Multichannel Signals Using a System of Pairwise Correlations" AES Convention for Spatial Audio Processing, Oct. 2012, pp. 1-15.

Gundry, Kenneth "A New Active Matrix Decoder for Surround Sound" AES 19th International Conference: Surround Sound-Techniques, Technology, and Perception, Jun. 1, 2001, pp. 1-9.

* cited by examiner

UPMIXING OF AUDIO SIGNALS

CROSS REFERENCE TO RELATED APPLICATIONS

This application claims priority to Chinese Patent Application No. 201510066647.9 filed on 9 Feb. 2015, and U.S. Provisional Application No. 62/117,229, filed on 17 Feb. 2015, each of which is hereby incorporated by reference in its entirety.

TECHNOLOGY

Example embodiments disclosed herein generally relate to audio signal processing, and more specifically, to upmixing of audio signals.

BACKGROUND

In order to create a more immersive audio experience, upmixing processes can be applied to the audio signals to create additional surround channels from the original audio signals, for example, from stereo to surround 5.1 or from surround 5.1 to surround 7.1, and the like. There are many upmixers and upmixing algorithms. In those conventional upmixing algorithms, the created additional surround channels are generally for floor speakers. In order to further improve the spatial immersive experience, some upmixing algorithms have been proposed to upmix the audio signals to height (overhead) speakers, such as from surround 5.1 to surround 7.1.2, where the "0.2" refers to the number of height speakers.

The conventional upmixing solutions usually only upmix the diffuse or ambiance signals in the original audio signal to the height speakers, leaving the direct signals in the floor speakers. However, some direct signals, such as the sounds of raining, thunder, helicopter or bird chirps, are natural overhead sounds. As a result, the conventional upmixing solutions sometimes cannot create a strong enough spatial immersive audio experience, or even cause some audible artifact in the upmixed signals.

SUMMARY

In general, the example embodiments disclosed herein provide a solution for the upmixing of audio signals.

In one aspect, an example embodiment disclosed herein provides a method of upmixing an audio signal. The method includes decomposing the audio signal into a diffuse signal and a direct signal, generating an audio bed based on the diffuse signal, the audio bed including a height channel, extracting an audio object from the direct signal, estimating metadata of the audio object, the metadata including height information of the audio object, and rendering the audio bed and the audio object as an upmixed audio signal, wherein the audio bed is rendered to a predefined position and the audio object is rendered according to the metadata.

In another aspect, an example embodiment disclosed herein provides a system for upmixing an audio signal. The system includes a direct/diffuse signal decomposer configured to decompose the audio signal into a diffuse signal and a direct signal, a bed generator configured to generate an audio bed based on the diffuse signal, the audio bed including a height channel, an object extractor configured to extract an audio object from the direct signal, a metadata estimator configured to estimate metadata of the audio object, the metadata including height information of the audio object and an audio renderer configured to render the audio bed and the audio object as an upmixed audio signal, wherein the audio bed is rendered to a predefined position and the audio object is rendered according to the metadata.

Through the following description, it would be appreciated that in accordance with the example embodiments disclosed herein, direct/diffuse signal decomposition is used to implement adaptive upmixing of the audio signals. The audio objects are extracted from the original audio signal and rendered according the height thereof, while the audio beds with one or more height channels can be generated and rendered into predefined speaker positions. As such, if an audio object is located relatively high in the scene, the audio object may be rendered by an overhead speaker. In this way, it is possible to produce more natural and immersive spatial experiences.

Moreover, in some example embodiments, the direct/diffuse signal decomposition, object extraction, bed generation, metadata estimation and/or the rendering can be adaptively controlled based on the nature of the input audio signal. For example, one or more of these processing stages may be controlled based on the content complexity of the audio signal. In this way, the upmixing effect can be further improved.

DESCRIPTION OF DRAWINGS

Through the following detailed description with reference to the accompanying drawings, the above and other objectives, features and advantages of the example embodiments will become more comprehensible. In the drawings, several embodiments will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
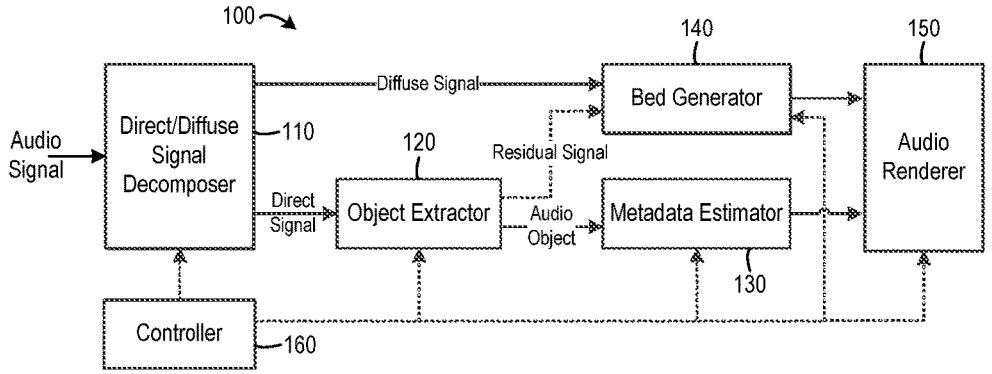
FIG. 1 is a block diagram of a system for audio signal upmixing in accordance with one example embodiment.

Principles of the example embodiments disclosed herein will now be described with reference to various example embodiments illustrated in the drawings. It should be appreciated that depiction of these embodiments is only to enable those skilled in the art to better understand and further implement the example embodiments and not intended for limiting the scope in any manner.

As used herein, the term "includes" and its variants are to be read as open-ended terms that mean "includes, but is not limited to." The term "or" is to be read as "and/or" unless the context clearly indicates otherwise. The term "based on" is to be read as "based at least in part on." The term "one example embodiment" and "an example embodiment" are to be read as "at least one example embodiment." The term "another embodiment" is to be read as "at least one other embodiment".

As used herein, the term "audio object" or "object" refers to an individual audio element that exists for a defined duration of time in the sound field. An audio object may be dynamic or static. For example, an audio object may be human, animal or any other object serving as a sound source in the sound field. An audio object may have associated metadata that describes the position, velocity, trajectory, height, size and/or any other aspects of the audio object. As used herein, the term "audio bed" or "bed" refers to audio channel(s) that is meant to be reproduced in pre-defined, fixed locations. Other definitions, explicit and implicit, may be included below.

Generally speaking, in accordance with example embodiments disclosed herein, the audio signal to be upmixed is decomposed into a diffuse signal and a direct signal. An audio object(s) can be extracted from the direct signal. By estimating the height of the audio object, the audio object can be rendered at the appropriate position, rather than being left in the floor speakers. In this way, the audio objects like thunder can be rendered, for example, via the overhead speakers. On the other hand, the audio bed(s) with one or more height channels can be generated at least in part from the diffuse signal, thereby achieving upmixing of the diffuse component in the original audio signal. In this way, the spatial immersive experience can be enhanced in various listening environments with an arbitrary speaker layout.

FIG. 1 illustrates a block diagram of a framework or system 100 for audio signal upmixing in accordance with one example embodiment disclosed herein. As shown, the system 100 includes a direct/diffuse signal decomposer 110, an object extractor 120, a metadata estimator 130, a bed generator 140, an audio renderer 150, and a controller 160. The controller 160 is configured to control the operations of the system 100.

The direct/diffuse signal decomposer 110 is configured to receive and decompose the audio signal. In one example embodiment, the input audio signal may be of a multichannel format. Of course, any other suitable formats are possible as well. In one example embodiment, the audio signal to be upmixed may be directly passed into the direct/diffuse signal decomposer 110. Alternatively, in one example embodiment, the audio signal may be subject to some pre-processing such as pre-mixing (not shown) before being fed into the direct/diffuse signal decomposer 110, which will be discussed later.

In accordance with example embodiments disclosed herein, the direct/diffuse signal decomposer 110 is configured to decompose the input audio signal into a diffuse signal and a direct signal. The resulting direct signal mainly contains the directional audio sources, and the diffuse signal mainly contains the ambiance signals that do not have obvious directions. Any suitable audio signal decomposition technique, either currently known or to be developed in the future, can be used by the direct/diffuse signal decomposer 110. Example embodiments in this aspect will be discussed later.

The direct signal obtained by the direct/diffuse signal decomposer 110 is passed into the object extractor 120. The object extractor 120 is configured to extract one or more audio objects from the direct signal. Any suitable audio object extraction technique, either currently known or to be developed in the future, can be used by the object extractor 120.

For example, in one example embodiment, the object extractor 120 may extract the audio objects by detecting the signals belonging to the same object based on spectrum continuity and spatial consistency. To this end, one or more signal features or cues may be obtained from the direct signal to measure whether the sub-bands, channels or frames of the audio signal belong to the same audio object. Examples of such audio signal features may include, but are not limited to, sound direction/position, diffusiveness, direct-to-reverberant ratio (DRR), on/offset synchrony, harmonicity, pitch and pitch fluctuation, saliency/partial loudness/energy, repetitiveness, and the like.

Additionally or alternatively, in one example embodiment, the object extractor 120 may extract the audio objects by determining the probability that each sub-band of the direct signal contains an audio object. Based on the determined probability, each sub-band may be divided into an audio object portion and a residual audio portion. By combining the audio object portions of the sub-bands, one or more audio objects can be extracted. The probability may be determined in various ways. By way of example, the probability may be determined based on the spatial position of a sub-band, the correlation between multiple channels (if any) of the sub-band, one or more panning rules in the audio mixing, a frequency range of the sub-band of the audio signal, and/or any additional or alternative factors.

The output of the object extractor 120 includes one or more extracted audio objects. Optionally, in one example embodiment, the portions in the direct signal which are not suitable to be extracted as the audio object may be output from the object extractor 120 as a residual signal. Each audio object is processed by the metadata estimator 130 to estimate the associated metadata. The metadata may range from the high-level semantic metadata to low-level descriptive information.

For example, in one example embodiment, the metadata may include mid-level attributes including onsets, offsets, harmonicity, saliency, loudness, temporal structures, and the like. Additionally or alternatively, the metadata may include high-level semantic attributes including music, speech, singing voice, sound effects, environmental sounds, foley, and the like. In one example embodiment, the metadata may comprise spatial metadata describing spatial attributes of the audio object, such as position, size, width, trajectory and the like.

Specifically, the metadata estimator 130 may estimate the position or at least the height of the each audio object in the three-dimensional (3D) space. By way of example, in one example embodiment, for any given audio object, the metadata estimator 130 may estimate the 3D trajectory of the audio object which describes the 3D positions of the audio object over time. The estimated metadata may describe the spatial positions of the audio object, for example, in the form of 3D coordinates (x, y, z). As a result, the height information of the audio object is obtained.

The 3D trajectory can be estimated by using any suitable technique, either currently known or to be developed in the future. In one example embodiment, a candidate position group including at least one candidate position for each of a plurality of frames of the audio object may be generated. An estimated position may be selected from the generated candidate position group for each of the plurality of frames based on a global cost function for the plurality of frames. Then the trajectory with the selected estimated positions across the plurality of frames may be estimated.

Referring back to the direct/diffuse signal decomposer 110, the diffuse signal is passed into the bed generator 140 which is configured to generate the audio bed(s). Optionally, if the audio object extraction by the object extractor 120 generates a residual signal, the residual signal may be fed into the bed generator 140 as well. As described above, the audio beds refer to the audio channels that are meant to be reproduced in pre-defined, fixed speaker positions. A typical audio bed may be in the format of surround 7.1.2 or 7.1.4 or any other suitable format depending on the speaker layout.

Specifically, in accordance with example embodiments disclosed herein, the bed generator 140 generates at least one audio bed with a height channel. To this end, in one example embodiment, the bed generator 140 may upmix the diffuse signal to the full bed layout (e.g., surround 7.1.2) to create the height channel. Any upmixing technique, either currently known or to be developed in the future, may be used to upmix the diffuse signal. It would be appreciated that the height channels of the audio beds do not necessarily need to be created by upmixing the diffuse signal. In various embodiments, one or more height channels may be created in other ways, for example, based on the pre-upmixing process, which will be discussed later.

For the residual signal from the object extractor 120, it may be included into the audio beds. In one example embodiment, the residual signal may be kept unchanged and directly included into the audio beds. Alternatively, in one example embodiment, the bed generator 140 may upmix the residual signal to those audio beds without height channels.

The audio objects extracted by the object extractor 120, the metadata estimated by the metadata estimator 130 and the audio beds generated by the bed generator 140 are passed into the audio renderer 150 for rendering. In general, the audio beds may be rendered to the predefined speaker positions. Specifically, one or more height channels of the audio beds may be rendered by the height (overhead) speakers. The audio object may be rendered by the speakers located at appropriate positions according to the metadata. For example, in one example embodiment, at any given time instant, if the height of an audio object as indicated by the metadata is greater than a threshold, the audio renderer 150 may render the audio object at least partially by the overhead speakers.

It is to be understood that although some embodiments are discussed with reference to the speakers, the scope of the example embodiments are not limited in this regard. For example, binaural rendering of the upmixed audio signal is possible as well. That is, the upmixed audio signal can be rendered to any suitable earphones, headsets, headphones, or the like.

In this way, unlike the conventional solutions where only the diffuse signal is upmixed while leaving the direct signal in the floor speakers, the direct signal is used to extract audio objects which can be rendered to the height speakers according their positions. By means of such hybrid upmixing strategy, the user experience can be enhanced in various listening environments with arbitrary speaker layouts.

Figure 2:
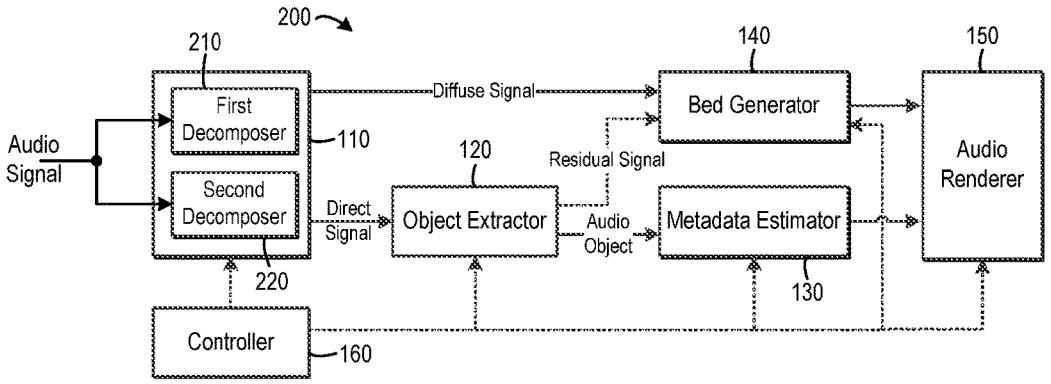
FIG. 2 is a block diagram of a system for audio signal upmixing in accordance with another example embodiment.

In accordance with example embodiments disclosed herein, the system 100 may have a variety of implementations or variations to achieve the optimal upmixing performance and/or to satisfy different requirements and use cases. As an example, FIG. 2 illustrates a block diagram of a system 200 for audio signal upmixing which can be considered as an implementation of the system 100 described above.

As shown, in the system 200, the direct/diffuse signal decomposer 110 includes a first decomposer 210 and a second decomposer 220 in order to better balance the extracted direct and diffuse signals. More specifically, it is found that for any decomposition algorithm, the obtained direct and diffuse signals are obtained with a certain degree of tradeoff. It is usually hard to achieve the good results for both direct and diffuse signals. That is, a good direct signal may cause some sacrifice on the diffuse signal, and vice versa.

In order to address this problem, in the system 200, the direct and diffuse signals are not obtained by a signal decomposition process or algorithm as in the system 100. Instead, the first decomposer 210 is configured to apply a first decomposition process to obtain the diffuse signal, while the second decomposer 220 is configured to apply a second decomposition process to obtain the direct signal. In this embodiment, the first and second decomposition processes have different diffuse-to-direct leakage and are applied separately to one other.

More specifically, in one example embodiment, the first decomposition process has less diffuse-to-direct leakage than the second decomposition to well preserve the diffuse component in the original audio signal. As a result, the first decomposition process will cause fewer artifacts in the extracted diffuse signal. On the contrary, the second decomposition process has less direct-to-diffuse leakage to well preserve the direct signal. In one example embodiment, the first and second decomposer 210 and 220 may apply different kinds of processes as the first and second decomposition processes. In another embodiment, the first and second decomposer 210 and 220 may apply the same decomposition process with different parameters.

Figure 3:
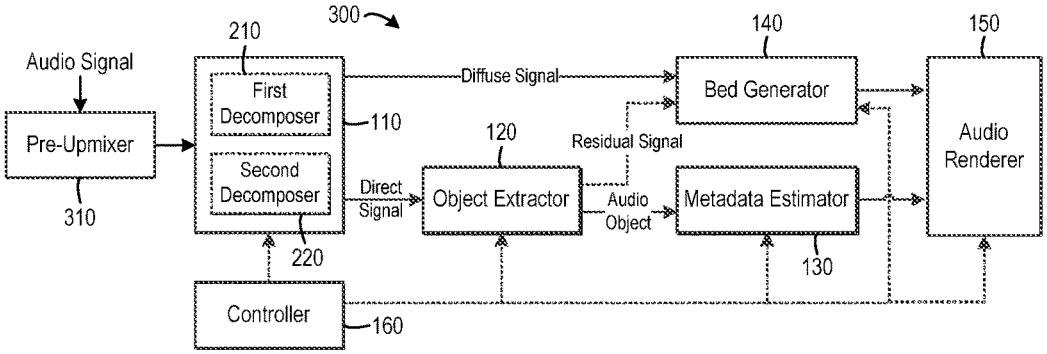
FIG. 3 is a block diagram of a system for audio signal upmixing in accordance with yet another example embodiment.

FIG. 3 illustrates the block diagram of an upmixing system 300 in accordance with another embodiment. The upmixing techniques as described above may generate different sound images compared with the legacy upmixers, especially for the audio signal in the format of surround 5.1 that is upmixed to surround 7.1 (with/without additional height channels). In a legacy upmixer, the left surround (Ls) and right surround (Rs) channels are typically located at the positions of ±110° with regard to the center of the room (the head position), and the left back (Lb) and right back (Rb) channels are generated and located behind the Ls and Rs channels. In the systems 100 or 200, due to the inherent property of spatial position estimation where the estimated position of the audio objects may have to be located in the region within the five bed channels, the Ls and Rs channels are typically put at the back corner of the space (that is, the positions of Lb and Rb), such that the resulting sound image can fill the whole space. As a result, in some situations, the sound image might be stretched backward to some extent in the systems 100 and 200.

In order to achieve better compatibility, in the system 300, the audio signal to be upmixed is subject to a pre-upmixing process. Specifically, as shown in FIG. 3, the decomposition of the audio signal is not performed directly on the original audio signal. Instead, the system 300 includes a pre-upmixer 310 which is configured to pre-upmix the original audio signal. The pre-upmixed signal is passed into the direct/diffuse signal decomposer 110 to be decomposed into the direct and diffuse signals.

Any suitable upmixer, either currently known or to be developed in the future, may be used as the pre-upmixer 310 in the system 300. In one example embodiment, a legacy upmixer can be used in order to achieve good compatibility. For example, in one example embodiment, the original audio signal may be pre-upmixed to an audio with a default, uniform format, for example, surround 7.1 or the like.

Another advantage can be achieved by the system 300 is that it is possible to implement consistent processing in the subsequent components. As such, the parameter tuning/selection for inputs with different formats can be avoided.

It would be appreciated that the systems 200 and 300 can be used in combination. More specifically, as shown in FIG. 3, in one example embodiment, the direct/diffuse signal decomposer 110 in the system 300 may include the first decomposer 210 and second decomposer 220 discussed with reference to FIG. 2. In this embodiment, the first and second decomposition processes are separately applied to the pre-upmixed audio signal rather than the original audio signal. Of course, it is possible to apply one decomposition process on the pre-upmixed audio signal.

Figure 4:
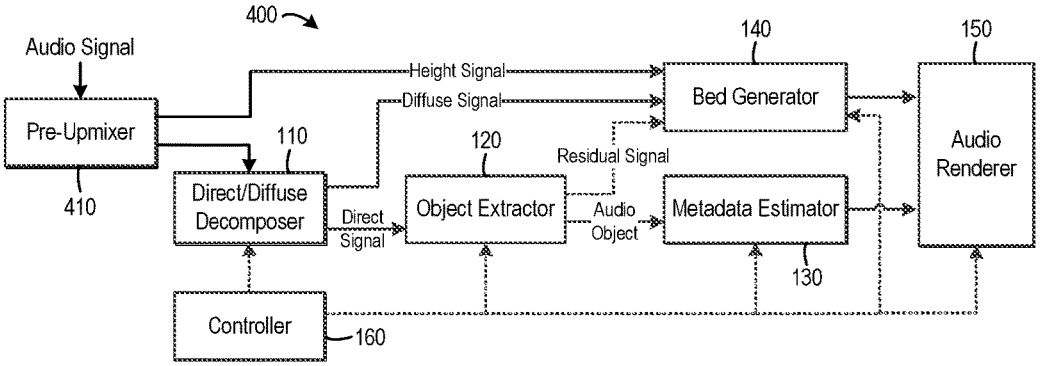
FIG. 4 is a block diagram of a system for audio signal upmixing in accordance with still yet another example embodiment.

FIG. 4 illustrates the block diagram of another variation of the upmixing system in one example embodiment. In the system 400 shown in FIG. 4, the pre-upmixer 410 performs pre-upmixing on the original audio signal. Specifically, the pre-upmixer 410 will upmix the audio signal to a format having at least one height channel. By way of example, in one example embodiment, the audio signal may be upmixed by the pre-upmixer 410 to surround 7.1.2 or other bed layout with height channels. In this way, one or more height signals are obtained via the pre-upmixing process.

The height signal obtained by the pre-upmixer 410 is passed to the bed generator 140 and directly used as a height channel(s) in the audio beds. As described above, the diffuse signal obtained by the direct/diffuse signal decomposer 110 and the residual signal (if any) obtained by object extractor 120 are passed to the bed generator 140. It would be appreciated that in this embodiment, the bed generator 140 does not necessarily upmix the diffuse signal since the height channels already exist. That is, the height channels of the audio beds can be created without upmixing the diffuse signal. The diffuse signal can be put into the audio beds.

Moreover, since the height channels are not generated from the diffuse signal, the direct/diffuse signal decomposer 110 in the system 400 may be implemented as the second decomposer 220 in the system as shown in FIG. 2, for example. In this way, a signal decomposition process having less direct-to-diffuse leakage may be applied to specifically preserve the direct component in the audio signal.

In addition, in the system 400, it is possible to only pass the floor channels of the upmixed audio signal from the pre-upmixer 410 to the direct/diffuse signal decomposer 110. By way of example, in one example embodiment, if the audio signal is pre-upmixed to surround 7.1.2, only the floor channels 7.1 can be fed into the direct/diffuse signal decomposer 110. Certainly, in an alternative embodiment, the pre-upmixer 410 may input the whole pre-upmixed audio signal into the direct/diffuse signal decomposer 110.

Figure 5:
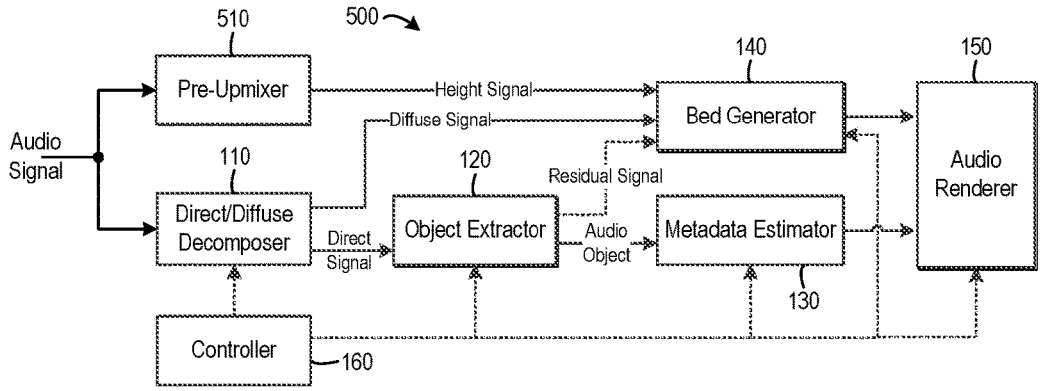
FIG. 5 is a block diagram of a system for audio signal upmixing in accordance with still yet another example embodiment.

It would be appreciated that in the system 400, the audio signal is decomposed by the direct/diffuse signal decomposer 110 by applying a decomposition process on the pre-upmixed signal or a part thereof (that is, the floor channels). In a variation, the direct/diffuse signal decomposition process may be performed on the original input audio signal rather than the pre-upmixed one. FIG. 5 shows the block diagram of such a system 500 in one example embodiment.

As shown, the system 500 includes the pre-upmixer 410 to pre-mix the input audio signal. Unlike the system 400 where the pre-upmixed audio signal or a part thereof is input to the direct/diffuse signal decomposer, the original audio signal is input to both the pre-upmixer 510 and the direct/diffuse signal decomposer 110. The pre-upmixer 510, like the pre-upmixer 410, generates a height signal by upmixing the input audio signal, for example, to surround 7.1.2 or the like. The height signal is input into the bed generator 140 to serve as the height channel.

The direct/diffuse signal decomposer 110 in the system 500 obtains the direct and diffuse signals by applying a decomposition process to the original audio content. Specifically, similar to the system 400, the direct/diffuse signal decomposer 110 may apply a decomposition process with less direct-to-diffuse leakage to well preserve the direct signal. Compared with the system 400, the object extractor 120 may extract the audio objects based on the direct component of the original audio signal instead of the upmixed signal. Without the upmix processing and its consequential effect, the extracted audio objects and their metadata may keep more fidelity.

It is to be understood that the systems 200 to 500 are some example modification or variation of the system 100. The systems 200 to 500 are discussed only for the purpose of illustration, without suggesting any limitation as to the scope of the invention.

Now the functionalities of the controller 160 will be discussed. For the sake of illustration, reference will be made to the system 100 illustrated in FIG. 1. This is only for the purpose of illustration, without suggesting any limitations as to the scope of the present invention. The functionalities of the controller described below apply to any of the systems 200 to 500 discussed above.

As mentioned above, the controller 160 is configured to control the components in the system. Specifically, in one example embodiment, the controller 160 may control the direct/diffuse signal decomposer 110. As known, in some decomposition processes, the audio signal may be first decomposed into several uncorrelated audio components. Each audio component is applied with a respective diffuse gain to extract the diffuse signal. As used herein, the term "diffuse gain" refers to a gain that indicates a proportion of the diffuse component in the audio signal. Alternatively, in one example embodiment, the diffuse gain may be applied to the original audio signal. In either case, the selection of an appropriate diffuse gain(s) is a key issue.

In one example embodiment, the controller 160 may determine the diffuse gain for each component of the audio signal based on the complexity of the input audio signal. To this end, the controller 160 calculates a complexity score to measure the audio complexity. The complexity score may be defined in various suitable ways. In one example embodiment, the complexity score can be set to a high value if the audio signal contains a mixture of various sound sources and/or different signals. The complexity score may be set to a low value if the audio signal contains only one diffuse signal and/or one dominant sound source.

More specifically, in one example embodiment, the controller 160 may calculate the sum of the power differences of the components of the audio signal. If the sum is below a threshold, it means that only the diffuse signal is included in the audio signal. Additionally or alternatively, the controller 160 may determine how even the power is distributed across the components of the audio signals. If the distribution is relatively even, it means that only the diffuse signal is included in the audio signal. Additionally or alternatively, the controller 160 may determine a power difference between a local dominant component in a sub-band and a global dominant component in a full band or in a time domain. Any additional or alternative metrics can be used to estimate the complexity of audio signal.

The controller 160 may then determine a diffuse gain for the audio signal based on the complexity of the audio signal. In one example embodiment, the complexity score may be mapped to a diffuse gain for each audio component of the audio signal. Specifically, it is to be understood that the diffuse gain described here may be implemented as a gain that is directly applied to each audio component, or as a multiplier (another gain) that is used to further modify the gain as initially estimated.

In one example embodiment, one or more mapping functions can be used to map the complexity score to the diffuse gains. In one example embodiment, it is possible to use non-linear functions which may be set for different audio components obtained intermediately in direct/diffuse decomposition. Of course, in an alternative embodiment, a single function may be used for the whole audio signal.

Figure 6:
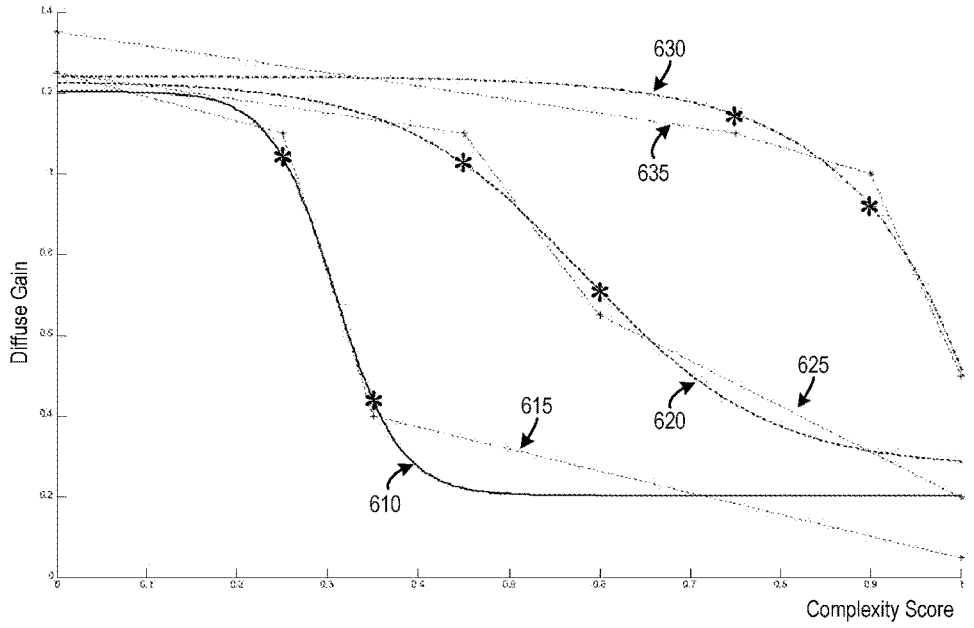
FIG. 6 is a schematic diagram of functions that map the complexity score of the input audio signal to diffuse gains for different components in accordance with one example embodiment.

FIG. 6 illustrates the schematic diagram of a set of mapping functions, each of which maps the complexity score to a diffuse gain to be applied to the associated signal component. The curve 610 indicates a mapping function for the most dominant component of the input audio signal, the curve 620 indicates a mapping function for the moderate component, and the curve 630 indicates a mapping function for the least dominant component. These non-linear functions may be generated by fitting the respective linear piecewise functions 615, 625 and 635 to the sigmoid functions. It can be seen that these non-linear functions may have one or more operation points (marked with asterisk in the figure) according to the operation mode control. In this way, the parameters of the operation curve can be tuned in a flexible and continuous manner.

In operation, the controller 160 may further adjust the functions in the context of the "less diffuse-to-direct leakage" and "less direct-to-diffuse leakage" modes. For example, when generating an enveloping diffuse sound field having no apparent direction, the operation points of the curve 610 may be tuned towards the middle line to implement a conservative mode for diffuse-to-direct leakage. For another example, in an extracting/panning/moving/separating application where the directional signals need to be as intact as possible, the operation points of the curves 620 and 630 may be tuned towards the curve 610 to achieve a conservative mode for direct-to-diffuse leakage.

Alternatively, in one example embodiment, the diffuse gain of each component of the audio signal may be estimated with learning models. In this embodiment, the models predict the diffuse gains based on one or more acoustic features. These gain values can be learned or estimated differently according to the operation mode input. In one example embodiment, the mixture of dominant sound sources and diffuse signals can be decomposed into several uncorrelated components. One or more acoustic features may be extracted. The target gains may calculate according to the selected operation mode. The models can be learned based on the acoustic features and target gains.

Additionally or alternatively, the controller 160 may control the object extraction performed by the object extractor 120 by selecting different extraction modes for the object extractor 120. By way of example, in one extraction mode, the object extractor 120 is configured to extract the audio objects as many as possible, in order to fully leverage the benefit of audio objects for final audio rendering. In another extraction mode, the object extractor 120 is configured to extract the audio objects as little as possible, in order to preserve the property of the original audio signal and to avoid possible timbre change and spatial discontinuity. Any alternative or additional extraction mode can be defined.

In one example embodiment, "hard decision" may be applied such that the controller 160 selects either of the extraction modes for the object extractor 120. Alternatively, "soft decision" may be applied such that two or more different extraction modes may be combined in a continuous way, for example, by virtue of a factor between 0 and 1 indicating the amount of audio objects to be extracted. In one example embodiment, the object extraction can be seen as a method to estimate and apply an object gain on each sub-band of the input audio signal. The object gain indicates a probability that the audio signal contains an audio object. A smaller object gain indicates a smaller amount of extracted objects. In this way, the selection of different extraction modes or the amounts of objects to be extracted may be achieved by adjusting the object gains.

Similar to the diffuse gain as described above, in one example embodiment, the controller 160 may determine the object gain based on the complexity of the input audio signal. For example, the complexity score described above may be used to determine the object gain and a similar curve(s) as illustrated in FIG. 6 may be applied as well. For example, the object gain may be set to a high value if the audio complexity is low. Accordingly, the controller 160 controls the object extractor 120 to extract the audio objects as many as possible. Otherwise, the object gain may be set to a low value if the audio complexity is high. Accordingly, the controller 160 controls the object extractor 120 to extract a fewer number of audio objects. This would be beneficial since in a complex audio signal, the audio objects usually cannot be well extracted and the audible artifacts might be introduced if too many objects are extracted.

It is to be understood that the object gain can be either the gain directly applied to audio signal (for example, each sub-band) or a multiplier (another gain) that is used to further modify the gain as initially estimated. That is, the object extraction can be controlled in a way similar to the direct/diffuse decomposition where an ambiance gain is estimated and/or adjusted. Moreover, in one example embodiment, a single mapping function can be applied to all the sub-bands of the audio signal. Alternatively, different mapping functions may be generated and applied separately for different sub-bands or different sets of sub-bands. In one example embodiment, the model-based gain estimation as discussed may be applied in this context as well.

In one example embodiment, the controller 160 may automatically determine the mode or parameters in the metadata estimation, especially the height estimation that determines the height of an audio object, based on the complexity of the audio signal. In general, different modes may be defined for the estimation of the height information. For example, in one example embodiment, an aggressive mode may be defined where the extracted audio objects are placed as high as possible to create a more immersive audio image. In another embodiment, the controller 160 may control the metadata estimator 130 to apply a conservative mode, where the audio objects are placed to be close to the floor beds (with a conservative height value) to avoid introducing the possible artifacts.

In order to select the appropriate mode for the height estimation, in one example embodiment, the controller 160 may determine a height gain based on the complexity of the audio signal. The height gain may be used to further modify the height information which is estimated by the metadata estimator 130. By way of example, the height of an extracted audio object can be reduced by setting the height gain less than 1.

In one example embodiment, the curves similar to those shown in FIG. 6 may be applied again. That is, the height gain may be set large or close to 1 when the complexity is low where objects can be well extracted and subsequently well rendered. On the other hand, the height gain may be set low when the audio complexity is high to avoid audible artifacts. This is because objects may not be well extracted in this case and it is possible that some sub-bands of one source are extracted as objects and other sub-bands of the same source are considered as residual. As a result, if the "objectified" sub-bands are placed higher, these sub-bands will differ too much compared with the "residualized" sub-bands of the same source, thereby introducing artifacts such as focus-lost.

In one example embodiment, the controller 160 may control the bed generation as well. As described above, the bed generator 140 takes inputs including the diffuse signal extracted from the direct/diffuse signal decomposer 110, and possibly the residual signal from the object extractor 120. There may be many options to deal with these two signals in the bed generation. For example, the diffuse signal extracted by the direct/diffuse signal decomposer 110 may be kept as 5.1 (if the original input audio is of the format of surround 5.1). Alternatively, it may be upmixed to surround 7.1 or 7.1.2 (or with other number of height speakers). Similarly, the residual signal from the object extractor 120 may be kept intact (such as in the format of surround 5.1), or may be upmixed to surround 7.1.

Combining different processing options of these two kinds of signals creates multiple modes. For example, in one mode, both the diffuse signal and the residual signal are upmixed to surround 7.1. In another mode, the diffuse signal is upmixed to surround 7.1.2 and the residual signal is intact. In one example embodiment, the system allows the user to indicate the desired option or mode depending on the specific requirements of the tasks in process.

In one example embodiment, the controller 160 may control the rendering of the upmixed audio signal by the audio renderer 150. It is possible to directly input the extracted audio objects and beds into any off-the-shelf renderer to generate the upmixing results. However, it is found that the rendered results may contain some artifacts. For example, instability artifacts may be heard due to the imperfection of the audio object extraction and the corresponding position estimation. It is likely that one audio object may be split into two objects in several different positions (artifacts may appear at the transition part) or several objects are merged together (the estimated trajectory becomes instable), and the estimated trajectory may be inaccurate if the extracted audio objects have four or five active channels. Moreover, in the binaural rendering, rendering an object close to the listeners' position (0.5, 0.5) may be still a problem. If the estimated position of an object is "sort of" fluctuation around (0.5, 0.5), instability artifacts may be clearly annoying.

In order to improve the quality of rendering, in one example embodiment, the controller 160 may estimate "goodness" metric measuring how good the estimated objects and position/trajectory can be. One possible solution is that, if the estimated objects and positions are good enough, the more audio object-intended rendering can be applied. Otherwise, the channel-intended rendering can be used.

In one example embodiment, the goodness metric may be implemented as a value between 0 and 1 and may be obtained based on one or more factors affecting the rendering performance. For example, the goodness metric may be low if one of the following conditions is satisfied: the extracted object have many active channels, the position of extracted object is close to the listener, the energy distribution among the channels are very different from the panning algorithm of a reference (speaker) renderer (i.e., maybe it is not an accurate object), and the like.

In one example embodiment, the goodness metric may be represented as an object-rendering gain to determine the level of the rendering related to the extracted audio objects by the audio renderer 150. In general, this object-rendering gain is positively correlated to the goodness metric. In the simplest case, the object-rendering gain can be equal to the goodness metric since the goodness metric is between 0 and 1. By way of example, the object-rendering gain may be determined based on at least one of the following: the number of active channels of the audio object, a position of the audio object with respect to a user, and energy distribution among channels for the audio object.

Figure 7:
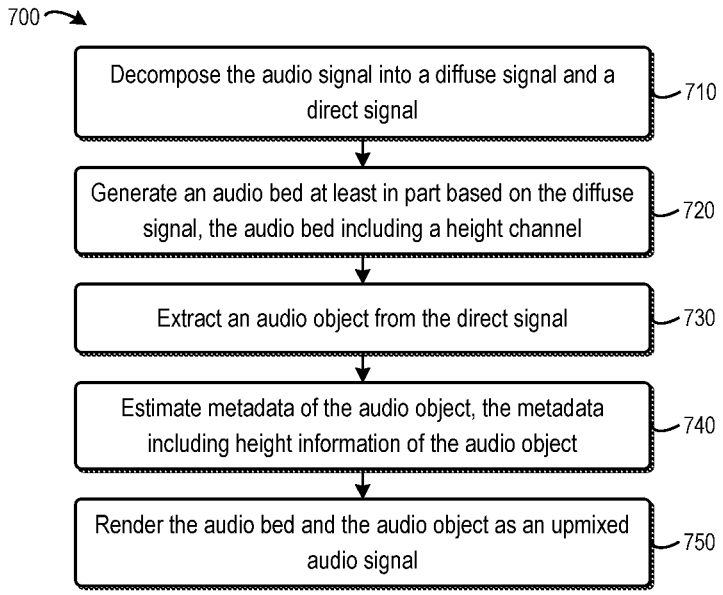
FIG. 7 is a flowchart of a method of upmixing the audio signal in accordance with one example embodiment.

FIG. 7 illustrates a flowchart of a method 700 of audio object upmixing. The method 700 is entered at step 710, where the audio signal is decomposed into a diffuse signal and a direct signal. In one example embodiment, at step 710, a first decomposition process may be applied to obtain the diffuse signal, and a second decomposition process may be applied to obtain the direct signal, where the first decomposition process has less diffuse-to-direct leakage than the second decomposition process. In one example embodiment, the audio signal may be pre-upmixed before step 710. In this embodiment, the first and second decomposition processes may be separately applied to the pre-upmixed audio signal.

Then at step 720, an audio bed including a height channel may be generated based on the diffuse signal. The generation of the audio bed comprises upmixing the diffuse signal to create the height channel, and including into the audio bed a residual signal that is obtained from the extracting of the audio object. In one example embodiment where the audio signal is pre-upmixed, at step 720, the height channel may be created by use of the height signal without upmixing the diffuse signal. In this embodiment, at step 710, the decomposition process may be applied to the pre-upmixed audio signal or a part thereof, or on the original audio signal.

An audio object(s) is extracted from the direct signal at step 730 and the metadata of the audio object is estimated at step 740. Specifically, the metadata includes height information of the audio object. It is to be understood that the bed generation and the object extraction and metadata estimation can be performed in any suitable order or in parallel. That is, in one example embodiment, steps 730 and 740 may be performed prior to or in parallel to step 720.

At step 750, the audio bed and the audio object are rendered as an upmixed audio signal, where the audio bed is rendered to a predefined position and the audio object is rendered according to the metadata.

As described above, in one example embodiment, the complexity of the audio signal may be determined, for example, in the form of a complexity score. In one example embodiment, a diffuse gain for the audio signal may be determined based on the complexity, where the diffuse gain indicates a proportion of the diffuse signal in the audio signal. In this embodiment, the audio signal may be decomposed based on the diffuse gain.

Additionally or alternatively, in one example embodiment, an object gain for the audio signal may be determined based on the complexity, where the object gain indicates a probability that the audio signal contains an audio object. In this embodiment, the audio object may be extracted based on the object gain. Additionally or alternatively, in one example embodiment, a height gain for the audio object may be determined based on the complexity. In this embodiment, the height of the audio object may be adjusted based on the height gain.

Additionally or alternatively, in one example embodiment, an object-rendering gain may be determined based on at least one of the following: the number of active channels of the audio object, a position of the audio object with respect to a user, and energy distribution among channels for the audio object. In this embodiment, the level of the audio object in the rendering of the upmixed audio signal may be controlled based on the object-rendering gain.

It is to be understood that the components of any of the system 100 to 500 may be hardware modules or software modules. For example, in some example embodiments, the system may be implemented partially or completely as software and/or firmware, for example, implemented as a computer program product embodied in a computer readable medium. Alternatively or additionally, the system may be implemented partially or completely based on hardware, for example, as an integrated circuit (IC), an application-specific integrated circuit (ASIC), a system on chip (SOC), a field programmable gate array (FPGA), and the like.

Figure 8:
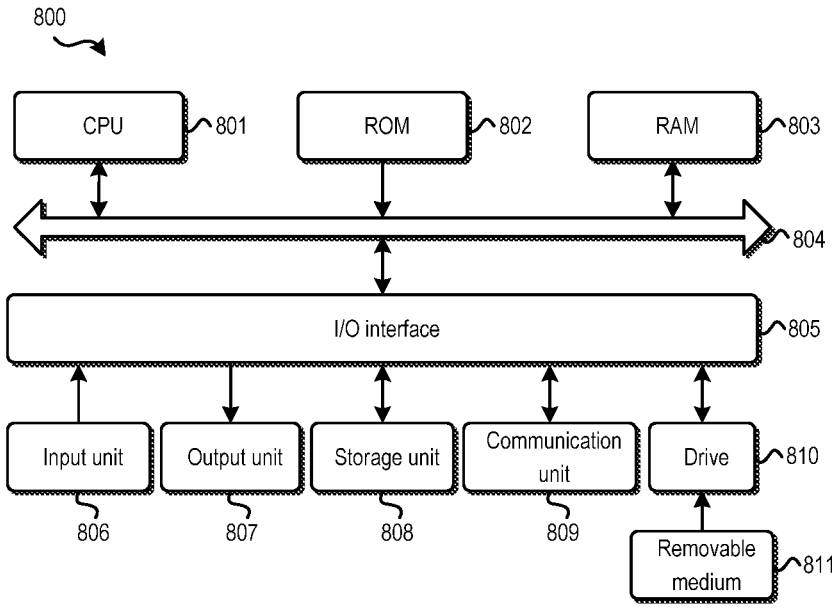
FIG. 8 is a block diagram of an example computer system suitable for implementing example embodiments.

FIG. 8 illustrates a block diagram of an example computer system 800 suitable for implementing example embodiments of the present invention. As shown, the computer system 800 comprises a central processing unit (CPU) 801 which is capable of performing various processes in accordance with a program stored in a read only memory (ROM) 802 or a program loaded from a storage unit 808 to a random access memory (RAM) 803. In the RAM 803, data required when the CPU 801 performs the various processes or the like is also stored as required. The CPU 801, the ROM 802 and the RAM 803 are connected to one another via a bus 804. An input/output (I/O) interface 805 is also connected to the bus 804.

The following components are connected to the I/O interface 805: an input unit 806 including a keyboard, a mouse, or the like; an output unit 807 including a display such as a cathode ray tube (CRT), a liquid crystal display (LCD), or the like, and a loudspeaker or the like; the storage unit 808 including a hard disk or the like; and a communication unit 809 including a network interface card such as a LAN card, a modem, or the like. The communication unit 809 performs a communication process via the network such as the internet. A drive 810 is also connected to the I/O interface 805 as required. A removable medium 811, such as a magnetic disk, an optical disk, a magneto-optical disk, a semiconductor memory, or the like, is mounted on the drive 810 as required, so that a computer program read therefrom is installed into the storage unit 808 as required.

Specifically, in accordance with example embodiments of the present invention, the processes described above may be implemented as computer software programs. For example, embodiments of the present invention comprise a computer program product including a computer program tangibly embodied on a machine readable medium, the computer program including program code for performing methods. In such embodiments, the computer program may be downloaded and mounted from the network via the communication unit 809, and/or installed from the removable medium 811.

Generally, various example embodiments of the present invention may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments of the present invention are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, embodiments of the present invention include a computer program product comprising a computer program tangibly embodied on a machine readable medium, the computer program containing program codes configured to carry out the methods as described above.

In the context of the disclosure, a machine readable medium may be any tangible medium that may contain, or store a program for use by or in connection with an instruction execution system, apparatus, or device. The machine readable medium may be a machine readable signal medium or a machine readable storage medium. A machine readable medium may include but not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments may also be implemented in combination in a single embodiment. Conversely, various features that are described in the context of a single embodiment may also be implemented in multiple embodiments separately or in any suitable sub-combination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other embodiments of the inventions set forth herein will come to mind to one skilled in the art to which these embodiments of the invention pertain having the benefit of the teachings presented in the foregoing descriptions and the drawings.

The present invention may be embodied in any of the forms described herein. For example, the following enumerated example embodiments (EEEs) describe some structures, features, and functionalities of some aspects of the present invention.

EEE 1. A new upmixing method including: extracting ambiance, objects and/or residuals and corresponding metadata from an audio signal, upmixing the ambiance and/or the residuals to generate beds, rendering the objects and beds by a renderer using binaural or speaker rendering and controlling the operation modes depending on the content of the audio signal being processed.

EEE 2. The method of EEE 1, wherein the direct/diffuse decomposition is performed in two separate modes to generate better diffuse signal for bed generation and better direct signal for object extraction.

EEE 3. The method of EEE 1, wherein the input audio signal is pre-upmixed to a certain speaker layout, such as surround 7.1.2 before the direct/diffuse decomposition, where a traditional channel-based upmixer can be used for pre-upmixing.

EEE 4. The method of EEE 3, wherein the height channels obtained from the pre-upmixing is directly wired to the audio beds, and one mode of direct/diffuse decomposition is applied to at least a part of the upmixed signal.

EEE 5. The method of EEE 3, wherein the height channels obtained from the pre-upmixing is directly wired to the audio beds, and one mode of direct/diffuse decomposition is applied to the original signal.

EEE 6. The method of EEE 1, wherein the residual is upmixed to more channels with or without height channels for bed generation.

EEE 7. The method of EEE 1, wherein different modes for the direct/diffuse decomposition, object extraction, metadata estimation and rendering are set by a controller depending on the processed content.

EEE 8. The method of EEE 7, wherein a diffuse gain is estimated based on the content to control the extracted diffuse and direct signal, and the diffuse gain is generated from a mapping function taking content complexity score as input.

EEE 9. The method of EEE 7, wherein an object gain is estimated based on the content to control the level of objectification in object extraction, and the object gain is generated from a mapping function taking content complexity score as input.

EEE 10. The method of EEE 7, wherein a height gain is estimated based on the content to modify the height of the extracted objects, and the height gain is generated from a mapping function taking content complexity score as input.

EEE 11. The method of any one of EEEs 8 to 10, wherein the mapping function(s) are configurable component-by-component based on operation mode control.

EEE 12. The method of any one of EEEs 8 to 10, wherein all the gains can be further estimated based on pre-learned models.

EEE 13. The method of EEE 7, wherein an object-rendering gain is estimated based on the goodness of the extracted objects and the estimated position to control the level of object-based rendering in the renderer, and the rendering result is a weighted sum of object rendering and channel rendering, where the weight is determined by the object-rendering gain.

It will be appreciated that the example embodiments disclosed herein are not to be limited to the specific embodiments as discussed above and that modifications and other embodiments are intended to be included within the scope of the appended claims. Although specific terms are used herein, they are used in a generic and descriptive sense and are not for purposes of limitation.

We claim:

1. A method of upmixing an audio signal, comprising:

decomposing the audio signal into a diffuse signal and a direct signal;

determining complexity of the audio signal;

generating an audio bed at least in part based on the diffuse signal, the audio bed including a height channel;

extracting an audio object from the direct signal;

estimating metadata of the audio object, the metadata including height information of the audio object;

determining at least one of a diffuse gain for the audio signal based on the complexity, an object gain for the audio signal based on the complexity, or a height gain for the audio signal based on the complexity; and rendering the audio bed and the audio object as an upmixed audio signal, wherein the audio bed is rendered to at least one predefined position and the audio object is rendered according to the metadata.

2. The method of claim 1, wherein the generating the audio bed comprises:

upmixing the diffuse signal to create the height channel; and including a residual signal into the audio bed, the residual signal obtained from the extracting of the audio object.

3. The method of claim 1, wherein the decomposing the audio signal comprises:

determining a diffuse gain for the audio signal based on the complexity, the diffuse gain indicating a proportion of the diffuse signal in the audio signal; and decomposing the audio signal based on the diffuse gain.

4. The method of claim 1, wherein the extracting the audio object comprises:

determining an object gain for the audio signal based on the complexity, the object gain indicating a probability that the audio signal contains an audio object; and extracting the audio object based on the object gain.

5. The method of claim 1, wherein the extracting the metadata comprises:

determining a height gain for the audio object based on the complexity; and modifying the height information of the audio object based on the height gain.

6. The method of claim 1, wherein the rendering the audio object comprises:

determining an object-rendering gain based on at least one of the following:

the number of active channels of the audio object, a position of the audio object with respect to a user, and energy distribution among channels for the audio object; and controlling, based on the object-rendering gain, a level of rendering related to the audio object in the rendering.

7. A method of upmixing an audio signal, comprising:

decomposing the audio signal into a diffuse signal and a direct signal;

generating an audio bed at least in part based on the diffuse signal, the audio bed including a height channel;

extracting an audio object from the direct signal;

estimating metadata of the audio object, the metadata including height information of the audio object and rendering the audio bed and the audio object as an upmixed audio signal, wherein the audio bed is rendered to at least one predefined position and the audio object is rendered according to the metadata, wherein the decomposing the audio signal comprises:

applying a first decomposition process to obtain the diffuse signal; and applying a second decomposition process to obtain the direct signal, the first decomposition process having less diffuse-to-direct leakage than the second decomposition process.

8. The method of claim 7, further comprising:

pre-upmixing the audio signal, wherein the first and second decomposition processes are separately applied to the pre-upmixed audio signal.

9. A computer program product of upmixing an audio signal, the computer program product being tangibly stored on a non-transient computer-readable medium and comprising machine executable instructions which, when executed, cause the machine to perform steps of the method according to claim 1.

* * * * *